US010500129B2

(12) United States Patent
Nielsen et al.

(10) Patent No.: US 10,500,129 B2
(45) Date of Patent: Dec. 10, 2019

(54) DEVICE FOR THE TREATING OF PAIN WITH HIGH AMPLITUDE LOW FREQUENCY SOUND IMPULSE STIMULATION

(71) Applicant: PaciniMedico ApS, Copenhagen SV (DK)

(72) Inventors: Peter Michael Nielsen, Søborg (DK); Jesper Rønager, København S (DK)

(73) Assignee: PaciniMedico ApS, København Sv (DK)

( * ) Notice: Subject to any disclaimer, the term of this patent is extended or adjusted under 35 U.S.C. 154(b) by 551 days.

(21) Appl. No.: 15/129,511

(22) PCT Filed: Mar. 27, 2015

(86) PCT No.: PCT/DK2015/050071

§ 371 (c)(1),
(2) Date: Sep. 27, 2016

(87) PCT Pub. No.: WO2015/144185

PCT Pub. Date: Oct. 1, 2015

(65) Prior Publication Data

US 2017/0173481 A1 Jun. 22, 2017

(30) Foreign Application Priority Data

Mar. 27, 2014 (DK) ..... 2014 70156

(51) Int. Cl.
*A61H 23/02* (2006.01)

(52) U.S. Cl.
CPC . *A61H 23/0236* (2013.01); *A61H 2201/0142* (2013.01); *A61H 2201/0149* (2013.01); *A61H 2201/165* (2013.01); *A61H 2201/1619* (2013.01); *A61H 2201/1623* (2013.01); *A61H 2201/1628* (2013.01); *A61H 2201/1654* (2013.01); *A61H 2201/50* (2013.01); *A61H 2201/5046* (2013.01); *A61H 2201/5048* (2013.01); *A61H 2201/5084* (2013.01);
(Continued)

(58) Field of Classification Search
CPC ..... A61H 23/0236; A61H 23/0245
See application file for complete search history.

(56) References Cited

U.S. PATENT DOCUMENTS 4,798,538 A 1/1989 Yagi
5,035,235 A 7/1991 Chesky
(Continued)

FOREIGN PATENT DOCUMENTS

FR 2991588 A1 12/2013
WO WO-2007/050659 A2 5/2007

OTHER PUBLICATIONS

International Search Report issued in co-pending international application Serial No. PCT/DK2015/050071, dated Sep. 2, 2015.

*Primary Examiner* — LaToya M Louis
(74) *Attorney, Agent, or Firm* — Dinsmore & Shohl LLP

(57) ABSTRACT

A system for relieving pain of a user includes an electromechanical transducer configured to generate generate tactile sound waves (vibrations) with a frequency between 5 Hz and 200 Hz, a holder configured to keep the transducer in a fixed position adjacent to the mesenterial and internal organs' Pacinian corpuscles located in the abdominal cavity of the user, and a controller configured to control the amplitude and frequency of the transducer.

34 Claims, 8 Drawing Sheets

(52) U.S. Cl.
CPC .. *A61H 2205/081* (2013.01); *A61H 2205/083* (2013.01); *A61H 2230/045* (2013.01); *A61H 2230/06* (2013.01); *A61H 2230/065* (2013.01); *A61H 2230/08* (2013.01); *A61H 2230/10* (2013.01); *A61H 2230/105* (2013.01); *A61H 2230/60* (2013.01); *A61H 2230/65* (2013.01)

(56) References Cited

U.S. PATENT DOCUMENTS

| | | | | |
|---|---|---|---|---|
| 5,553,148 | A * | 9/1996 | Werle | H04R 5/023 381/151 |
| 5,913,834 | A | 6/1999 | Francais | |
| 2004/0097850 | A1 | 5/2004 | Plante | |
| 2007/0290825 | A1 * | 12/2007 | Koutsky | B60N 2/0244 340/438 |
| 2008/0269629 | A1 | 10/2008 | Reiner | |
| 2011/0237989 | A1 | 9/2011 | Vandenbelt et al. | |
| 2012/0051579 | A1 | 3/2012 | Cohen | |
| 2014/0005579 | A1 * | 1/2014 | Drlik | A61H 23/0218 601/111 |
| 2014/0010387 | A1 * | 1/2014 | Cohen | A61H 23/0236 381/151 |
| 2015/0011968 | A1 * | 1/2015 | Weatherhead | A61B 5/1079 604/503 |

* cited by examiner

DEVICE FOR THE TREATING OF PAIN WITH HIGH AMPLITUDE LOW FREQUENCY SOUND IMPULSE STIMULATION

FIELD OF INVENTION

The invention relates to a system for relieving pain by means of sound waves, and a method for determining the optimal stimulation parameters to use in the treatment.

BACKGROUND OF INVENTION

Pain is the most common symptom of disease and a frequent long term complication to many diseases. Nociceptive pain (occurring from any body damage) may be treated with pharmaceutical drugs whereas neurogenic pain occurring from damage to either the peripheral or the central nervous system is often difficult to treat with medication. Scientific brain mapping studies with magnetic resonance imaging (MRI) and positron emission tomography (PET) have shown that that the central pathways and cortical representation of the sensory system is almost congruent for painful stimuli and vibrotactile stimuli.

It is known that sound wave stimulation can help relieving pain by activating/blocking the areas of the brain that otherwise deliver the pain perception. The hypothesis that such afferent stimulation can reduce the perceived pain is based on both scientific discoveries and experience. In 1950-54 the neurophysiologist Amassian discovered that simultaneous stimulation of the Nn. Splanchnici (afferent nerves from the abdominal cavity) and N. Ulnaris (from the arm) leads to a decrease of the amplitude registered in the S2 area of the brain (which receives all afferent impulses and is responsible for the detection and location of sensitive inputs) compared to the amplitude when N. Ulnaris is stimulated alone. This discovery provides the theoretical basis for reducing the perceived somatic pain by generating afferent impulses to Nn. Splanchnici.

The Pacinian corpuscles (mechanoreceptors capable of detecting pressure/vibration) send afferent impulses through thick, well myelinated nerve fibres resulting in impulses propagating through the nervous system with maximal amplitude and velocity. They are particularly susceptible to vibrations and pressure and located in the skin and various internal organs. The Pacinian corpuscles in the skin respond to frequencies below 600 Hz and are most sensitive to vibrations around 250 Hz.

SUMMARY OF INVENTION

There are vibration systems for pain relieving described in the prior art. These systems are capable of stimulating the mechanoreceptors in the skin. The present disclosure relates to a system for relieving pain of a user more efficiently than the existing vibration systems by generating high amplitude low frequency tactile sound waves (5-200 Hz) with a powerful transducer targeting the Pacinian corpuscles in the mesenterium and abdominal cavity. The presently disclosed system has means for electrical-acoustical/electrical-mechanical transduction/tactile transduction and a holder configured to keep the transducer in a fixed position adjacent to the mesenterial and internal organs' Pacinian corpuscles located in the abdominal cavity of the user. The inventors have realized that by targeting these Pacinian corpuscles specifically, a greater pain relief is obtained compared to stimulation of the Pacinian corpuscles in the skin. In one embodiment of the presently disclosed system the transducer is attached to a plate made of a material suitable for propagating the tactile sound waves (vibrations) to the body. The system further comprises a means for holding the transducer and plate in a fixed position adjacent to the abdominal cavity, either on the front side or the back side of the body. In one implementation of the system, the holder of the transducer is attached to a belt/band/strap.

There are a large number of Pacinian corpuscles in association with the mesenterium and internal organs. The inventors have realized that the fact that low frequency impulses pass almost freely through the abdominal wall makes these Pacinian corpuscles particularly suitable for stimulation to reduce pain by means of a powerful electromechanical transducer. It should also be noted that, unlike the Pacinian corpuscles in the skin, they are not directly exposed to external touch or vibrations, which is assumed to lead to a better signal-to-noise ratio.

Music has a relaxing effect and can influence pain perception. Therefore, one embodiment of the presently disclosed system for relieving pain further comprises an audio playback unit for playing music to the user to maximise the perceived effects of the transducer.

A further aspect of the system described in the present disclosure regards a chair with the transducer and plate built-in to the backrest. Alternatively, the transducer is built-in to a bed.

A further aspect of the present disclosure relates to a method for determining the most efficient set of tactile sound wave parameters for a specific user. In an examination session a test series of predefined high amplitude low frequency (5-200 Hz) tactile sound waves are executed. For each test the corresponding evoked potential (recorded electrical potential from the neurons of the brain), or, alternatively, electroencephalography (EEG), electromyography (EMG) or other measures of brain responses, represents the efficiency of the set of parameters. When the entire series of tests has been executed, the responses are ranked according to efficiency and the most efficient set of tactile sound wave parameters is selected for the treatment session.

DESCRIPTION OF DRAWINGS

The invention will in the following be described in greater detail with reference to the accompanying drawings. The drawings are exemplary and are intended to illustrate some of the features of the present method and unit and are not to be construed as limiting to the presently disclosed system for relieving pain.

DETAILED DESCRIPTION OF THE INVENTION

Figure 1:
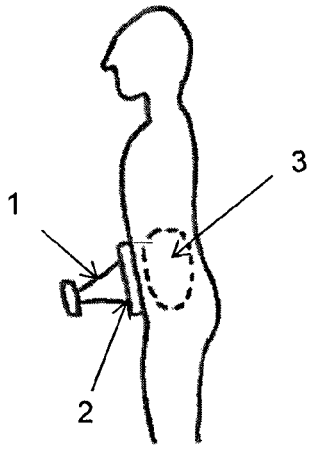
FIG. 1 shows an electromechanical/electroacoustic transducer (drawn as a loudspeaker symbol) attached to a plate made of a material suitable for propagating tactile sound waves (vibrations), fixed to the front side of the body of a user.

Vibroacoustic equipment is known in the art. WO 2007/050659, which describes a vibroacoustic sound therapeutic system, is partly based on the fact that Pacinian corpuscles send neurological non-pain messages to the brain that appear to inhibit the pain impulse (i.e. based on the same scientific background as presented above). The system described in WO 2007/050659 includes an acoustic transducer adapted for operation in a liquid medium; one of the three desired results of the treatment is the 'Skin Mechanoreceptor Effect', in which the pressure wave hits the skin, activates the mechanoreceptors in the skin, and creates a signal that goes to the brain.

However, the system described in WO 2007/050659 and other vibration systems for pain relieving, in some cases based on sound waves in the air and in some cases using vibrotactile equipment, are capable of stimulating the mechanoreceptors in the skin but do not target the mesenterial and internal organs' Pacinian corpuscles using a powerful electromechanical/electroacoustic transducer. The inventors of the presently disclosed system have realized that by targeting the Pacinian corpuscles in the mesenterium and abdominal cavity specifically with a powerful transducer, a greater pain relief is obtained compared to stimulation of the Pacinian corpuscles in the skin. In the presently disclosed system a powerful electromechanical transducer is placed adjacent to the mesenterial and internal organs' Pacinian corpuscle dense regions located in the abdominal cavity of the user. The tactile sound waves described in the present disclosure can be described as strong vibrations that are clearly sensed through the body, approaching, but not reaching, a painful or unpleasant level. The tactile sound waves are particularly intended to stimulate the large number of Pacinian corpuscles in the mesenterium and the organs of the abdominal cavity.

In the presently disclosed system for relieving pain an electromechanical transducer generates low frequency tactile sound waves to the body. The low frequency tactile sound waves pass through the abdominal wall and stimulate the Pacinian corpuscles in the abdominal cavity. The transducer can be placed directly on the body to have a direct propagation of the generated tactile sound waves. In another embodiment the transducer is attached to at least one plate made of a material suitable for propagating the tactile sound waves to the body, for example wood, metal or plastic. The plate may be in direct contact with the body, which has the advantage that it can potentially propagate the tactile sound waves to a larger area than the transducer alone. In one embodiment of the presently disclosed system the plate is circle shaped or elliptic. The plate can have any shape that maximises that contact area to the soft tissue close to the abdominal cavity of the user and feels comfortable for the user. This means that the plate(s) can be shaped to attach to any area between the ribs and hip bone, both on the front side and the back side of the body. The advantage of having a shape of the plate that maximizes the contact area to the soft tissue of the user is that more tactile sound waves can be absorbed and propagated to the Pacinian corpuscles in the mesenterium and abdominal cavity, which can potentially give a greater pain relief for the user. If there is more than one plate, the transducer shall be in direct contact with all of the plates. Should the transducer itself or the plate(s) be in contact with the skeleton of the user, it may cause an unpleasant feeling for the user; however it may also have the effect that the sound waves are propagated more efficiently through the whole body and thus stimulate additional Pacinian corpuscles as a positive side effect.

In one embodiment the system comprises metal rods between the plate and the transducer. An example of this embodiment can be seen in FIG. 8. In this example the rods are attached to the transducer by nuts. The attachment to the plate is not visible in this example since the plate is inside the backrest of the chair. In this embodiment the rods extend through the backrest of the chair, wherein the transducer is mounted on the rod(s) on the backside of the backrest of the chair. In one embodiment, the transducer is detachable from the rods, which provides both convenience in terms of storage, and it gives the opportunity to use one transducer for several chairs/beds/plates. The means for detaching the transducer may comprise any kind of quick-release mounting, for example configured to be clipped to the rods.

In one embodiment of the presently disclosed system the transducer is attached to a belt, band or strap. The two main advantages of attaching the transducer to a belt/strap/band is that if the belt/strap/band is tightened the transducer stays in contact with the body of the user and it does not move during a treatment session or between the examination session (described below) and the treatment session. The inventors of the system described in the present disclosure have realized the importance of the possibility to keep the transducer in the same position for an examination session and a treatment session in order to perform the treatment that has been found to work best for the user. It can also be seen as a means to reproduce the configuration in a later treatment session. The belt/band/strap may be combined with the plate(s) described above.

It is known that a state of relaxation can be beneficial for pain reduction. In another embodiment of the present disclosure the holder of the transducer is built-in to or on to the backrest of a chair or a bed to maximise the comfort of the user during the examination and treatment sessions.

It is beneficial for the invention to maximise transmission of vibrations from the transducer to the body of the user. Therefore, a further aspect of the invention, the system further comprises at least one bag of gel placed between the user and the transducer, wherein the at least one bag of gel is configured to transfer the tactile sound waves from the transducer to the user. If the holder comprises a plate, the bag of gel is preferably placed between the plate and the body of the user, in contact with both.

Figure 7:
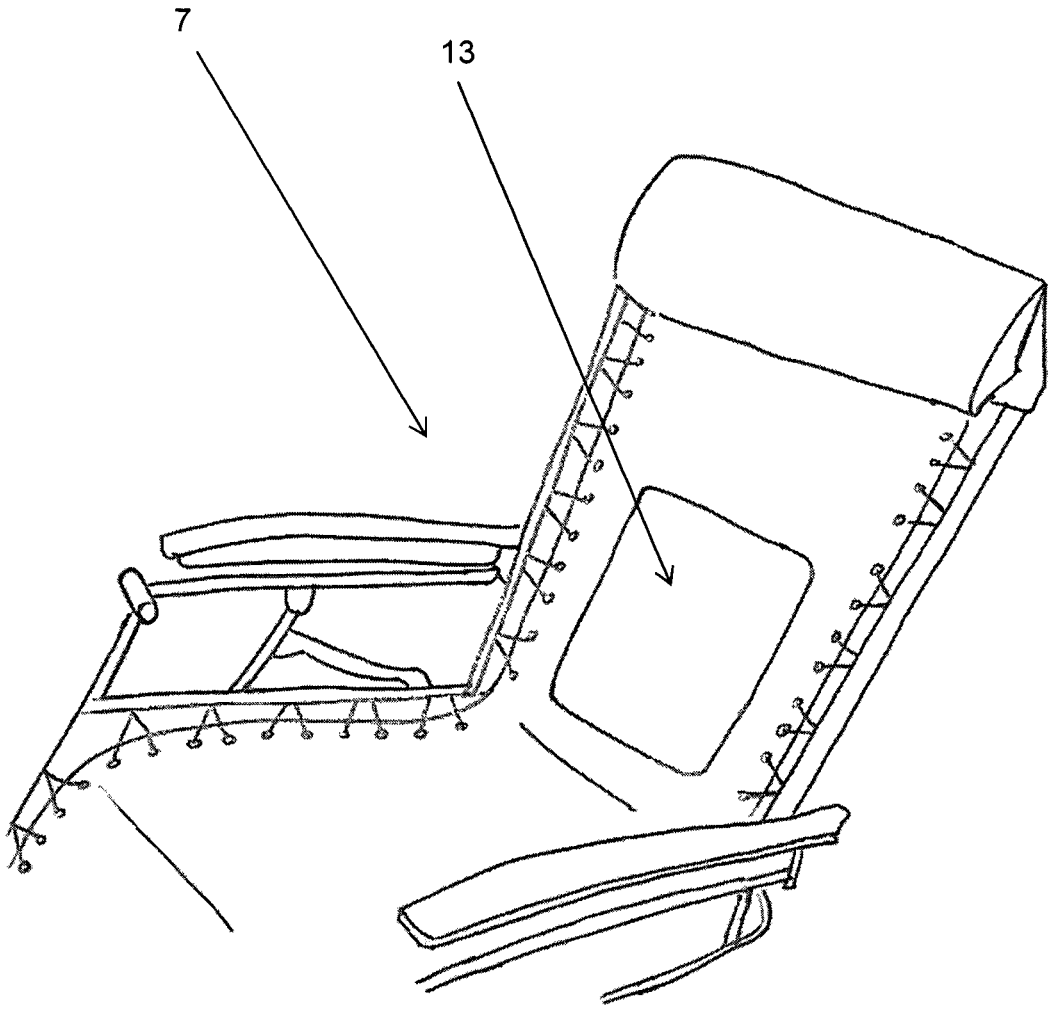
FIG. 7 shows an embodiment of a chair comprising an embodiment of a system for relieving pain according to the presently disclosed invention.

If the system comprises a chair, the bag of gel may be built-in to the backrest of the chair. FIG. 7 shows an embodiment of a chair comprising an embodiment of a system for relieving pain according to the presently disclosed invention. In this embodiment the chair has a pocket 13, in which the back of gel can be inserted.

A further aspect of the invention relates to the system comprising an accelerometer (G-meter). Vibration can be measured as acceleration ($m/s^2$). The accelerometer may be placed on the transducer, on the plate, on the bag of gel or on the user. There are several purposes of measuring the vibrations. The results may be used as references for future sessions, but they can also be used to indicate unpleasant or unhealthy levels of vibration. Therefore, in one embodiment of the present invention the accelerometer further comprises an alarm element configured to generate an alert if the measured vibration exceeds a predefined limit. Such predefined limit may be for example in the range of 0.1-1.0 $m/s^2$, or 0.3-1.5 $m/s^2$, or 0.5-2.0 $m/s^2$, or 1.0-2.5 $m/s^2$, such as 0.1 $m/s^2$, or 0.2 $m/s^2$, or 0.3 $m/s^2$, or 0.4 $m/s^2$, or 0.5 $m/s^2$, or 0.6 $m/s^2$, or 0.7 $m/s^2$, or 0.8 $m/s^2$, or 0.9 $m/s^2$, or 1.0 $m/s^2$, or 1.1 $m/s^2$, or 1.2 $m/s^2$, or 1.3 $m/s^2$, or 1.4 $m/s^2$, or 1.5 $m/s^2$, or 1.6 $m/s^2$, or 1.7 $m/s^2$, or 1.8 $m/s^2$, or 1.9 $m/s^2$, or 2.0 $m/s^2$, or 2.1 $m/s^2$, or 2.2 $m/s^2$, or 2.3 $m/s^2$, or 2.4 $m/s^2$, or 2.5 $m/s^2$, or a percentage of a predefined value indicated by authorities in a specific country.

Low frequency in the present disclosure may refer to the transducer frequency at which the pain relieving effect is maximized for a specific user. The optimal frequency may vary from user to user. The Pacinian corpuscles respond to frequencies below 600 Hz. The Pacinian corpuscles in the skin are most sensitive to vibrations around 200-300 Hz (see for example Mark F. Bear et al, Neuroscience: Exploring the Brain, 3rd Edition, Lippincot Williams & Wilkins, 2007). In examination tests, in which the Pacinian corpuscles in the abdominal cavity were stimulated, the optimal frequencies for the perception of relieved pain by the user have been found to be lower and vary from user to user. These results are explained by factors as for example how easily the vibrations pass through the abdominal wall and internal organs at different frequencies, the size and shapes of the body parts of different users. A further parameter for the overall perception of pain relief by the user is the number of stimuli. A lower frequency may give a more efficient result for each stimulus but a higher frequency may compensate the lack of efficiency in each stimulus by the fact that there are more stimuli per time unit. In summary, low frequency as used herein is not a constant figure but depends on a number of parameters. Practical experience shows that for example tactile sound wave transducers from the Butt-Kicker® family ("silent subwoofers" i.e. sending low frequency sound waves directly into the listener's body) by the Guitammer, working in the range of 5-200 Hz, can provide useful stimulation frequencies in the presently disclosed system and method.

High amplitude in connection with the present disclosure can be seen as a subjective term and refers to the user's perception of the power of the tactile sound waves. High amplitude vibrations in this context can be defined as vibrations that are sensed strongly through the body of the user without being painful. A powerful home cinema transducer based on sound waves through other mediums than air, with a specified power handling in the range of 75-2000 W, can serve as reference for a level of vibration in the right range. A measured peak power of 350 W for such a transducer when generating a sinusoidal wave can serve as an example and reference of an amplitude level that has been useful in tests for some users. Alternatively, the vibrations can be measured as acceleration ($m/s^2$). In one embodiment, the transducer according to the present invention may operate within the range of 0.0-1.0 $m/s^2$, or 0.0-1.5 $m/s^2$, or 0.0-2.0 $m/s^2$, or 0.0-2.5 $m/s^2$, or 0.0-2.5 $m/s^2$, or 0.0-3.0 $m/s^2$, or 0.0-3.5 $m/s^2$, or 0.0-4.0 $m/s^2$, or 0.0-4.5 $m/s^2$, or 0.0-5.0 $m/s^2$.

Music has a relaxing effect and can have a positive influence on pain perception. One embodiment of the presently enclosed system further comprises an audio playback unit for playing music to the user to further amplify the perceived pain relieving effect of the transducer.

In one embodiment of the presently disclosed system, music is played to the user while the high amplitude low frequency tactile sound waves are synchronised with tones in a chosen frequency range. Preferably the frequency range is selected such that distinct bass tones in the music trigger the generation of high amplitude low frequency tactile sound waves. The advantage with such synchronization is that in some cases it may lead to a better overall harmony and relaxation perceived by the user which may lead to more efficient pain relieving.

The present disclosure also relates to a method, wherein the high amplitude low frequency tactile sound waves are characterized by the audio waves in the music i.e. the electromechanical transducer plays the same vibrations as in music within the supported frequency range. This usage corresponds to how an electromechanical transducer in a home cinema, using mechanical waves through other mediums than air, generates the vibrations based on music, film effects etc. This synchronization may give an increased feeling of harmony for some users, contributing to relaxation and possibilities for improved pain relief.

A further synchronisation method is based on the availability of separate channels in the played music, which allows the controller to synchronize the high amplitude low frequency tactile sound waves with the sounds of a particular channel. This synchronization may in practice be similar to the synchronization with distinct bass tones described above, however with the potential benefit that the whole content to be synchronized with is held in a separate channel and thus does not have to be selected or separated.

The present disclosure also relates to a method, wherein the high amplitude low frequency tactile sound waves are manually programmed, either to test a certain stimulation pattern or to program a pattern that the user responds particularly well to or the user specifically asks for. This has the advantage that it allows for further customization of the individual needs and wishes of the user with the potential to give an increased feeling of harmony for some users.

A further aspect of the invention relates to the system being capable of providing biofeedback in a closed loop. The may be done by for example sensors configured to measure electrocardiography, and/or hear rate variability, and/or electromyography, and/or galvanic skin response. The system may also comprise a camera configured to measure a diameter of a pupil of the user. The size of the pupil is an almost instant reflection of an activation of the sympathetic nervous system. The above measured values can be used to vary the amplitude and/or frequency of the transducer and/or the music played to the user. In an alternative embodiment, a device such as a tablet computer with a touch screen (e.g. iPad) may be used to register levels of mood and pain of the user manually.

The present disclosure also relates to a method for determining a set of tactile sound parameters, comprising the steps of executing a predefined sequence of tests of tactile sound waves between 5 Hz and 200 Hz, stimulating the Pacinian corpuscles located in the abdominal cavity of the user, wherein each test corresponds to a set of frequency and amplitude parameters, collecting brain response data from the user for each test, obtaining a collection of data, selecting the most efficient set of tactile sound wave parameters for the user by ranking a collection of data of brain responses for each of the tests.

The method for determining a set of tactile sound parameters may also comprise the steps of providing a collection of brain response data from a user, wherein said brain response data was collected while the Pacinian corpuscles located in the abdominal cavity of the user were stimulated by executing a predefined sequence of tests of tactile sound waves between 5 Hz and 200 Hz, wherein each test corresponds to a set of frequency and amplitude parameters, selecting the most efficient set of tactile sound wave parameters for the user by ranking the collection of data of brain responses for each of the tests.

Brain response in this context may refer to for any type of brain response that can be registered including for example electroencephalography and electromyography, but may also refer to subjective data provided manually by the user.

Preferably the method is carried out using the system for relieving pain described above.

In the examination session, the test sequence comprises a number of individual tests.

In each test a short stimulus of tactile sound waves is generated, preferably by means of an electromechanical transducer described in the present disclosure, with a predefined frequency of for example 128 Hz. A stimulus in an examination session can also be any other frequency in the defined operating range of the transducer i.e. 5-200 Hz. In order to examine how the user responds to different stimulation frequencies, a sequence of tests with different stimulation frequencies is executed (frequency sweep). One example of such a test sequence would be to begin with a 5 Hz test stimulus, then increase the stimulation frequency by 1 Hz to 6 Hz and execute the test, then 7 Hz, then 8 Hz, then 9 Hz and so forth. The three last tests in such a sequence are 198 Hz, 199 Hz and 200 Hz. To reduce the number of tests and still cover the operation range 5-200 Hz it is also possible to use frequency increments greater than 1 Hz. The increments may be for example 2 Hz, 3 Hz, 4 Hz, 5 Hz, 6 Hz, 7 Hz, 8 Hz, 9 Hz, 10 Hz, 11 Hz, 12 Hz, 13 Hz, 14 Hz, 15 Hz, 16 Hz, 18 Hz, 20 Hz, 25 Hz, 30 Hz, 35 Hz, 40 Hz, 45 Hz, 50 Hz or 100 Hz. For example a test sequence using frequency increments of 15 Hz would perform the following tests: 5 Hz, 20 Hz, 35 Hz, 50 Hz, 65 Hz, 80 Hz, 95 Hz, 110 Hz, 125 Hz, 140 Hz, 155 Hz, 170 Hz, 180 Hz, and 200 Hz.

Similarly the amplitude of the tactile sound waves can be varied in the examination session in order to find the most efficient amplitude for the pain relieving of the user. The amplitude levels to test can either be executed for each frequency above or, as an alternative to reduce the number of tests, the frequency sweep described above is executed for one amplitude and when the most efficient frequencies for the user have been determined, the amplitude sweep is only performed for those frequencies. Since high amplitude in connection with the present disclosure can be seen as a subjective term and refers to the user's perception of the power of the tactile sound waves, a reasonable working power of the electromechanical transducer has used. For example a powerful home cinema transducer operating with a power handling in the range of 75-2000 W has turned out to provide an efficient level of sound wave amplitudes for some users. A further reference for the same transducer is a measured peak power of 350 W, which has been useful in tests for some users. For such a transducer the increments may be for example 1 W, 2 W, 3 W, 4 W, 5 W, 6 W, 7 W, 8 W, 9 W, 10 W, 11 W, 13 W, 15 W, 20 W, 25 W, 30 W, 35 W, 40 W, 45 W, 50 W, 100 W, 200 W, 300 W, 400 W, 500 W, 600 W, 700 W, 800 W, 900 W, 1000 W, 1200 W, 1400 W, 1600 W, 1800 W or 2000 W. For example a test sequence for a given stimulation frequency, using amplitude increments of 25 W and a transducer operating between 75 W and 400 W would perform the following tests: 75 W, 100 W, 125 W, 150 W, 175 W, 200 W, 225 W, 250 W, 275 W, 300 W, 325 W, 350 W, 375 W and 400 W. These figures are examples for one transducer and may be different for a different transducer.

The length of the stimulation time is a parameter for the examination itself, i.e. to optimize the accuracy of the test results, however not a parameter that is important in the treatment session. In order to have as clean stimulation as possible in the examination, it is preferable to use as short stimulation as possible in the examination session. The shortest theoretical period of time for a sinusoidal wave corresponds to one period (stimulation pulse). Depending on the other examination parameters and external conditions related to for example the equipment, the tests may have to be set up to execute several stimulation pulses in order to get a stronger response that is not lost in the noise.

Immediately after each stimulus (test) a brain response is expected. A response of the stimulus can be for example an evoked potential graph (recorded electrical potential from the nervous system). After the short stimulation has stopped there is usually an amplitude peak in the response after a period of time corresponding to the time it takes for the Pacinian corpuscle to react and the signal to propagate from the Pacinian corpuscle to the brain. This peak can be identified in the evoked potential graph. The amplitude of the peak is measured. Evoked potential amplitudes are low and sensible to noise, hence the test is repeated a number of times and the evoked potentials for all tests are collected and averaged. The test can be repeated for example 2 times, 3 times, 4 times, 5 times, 6 times, 7 times, 8 times, 9 times, 10 times, 12 times, 14 times, 16 times, 18 times, 20 times, 30 times, 40 times, 50 times, 100 times or more. When all tests (i.e. all predefined combinations of frequencies and amplitudes) have been executed the responses for each type of stimulus are sorted after peak amplitude and the most efficient set of frequency and amplitude parameters are selected for the treatment session.

Preferably a computer program can automate the examination session by executing the test sequence, collecting the data responses, average and sort after peak amplitudes and select the most efficient parameters for the treatment session. The computer program can also prepare the treatment session by importing the parameters to the controller, which can create the sound wave signals to be transduced and synchronize them with for example bass tones or the beat of the music.

A further aspect of the presently disclosed invention relates to a chair comprising and/or incorporating the system for relieving pain according to the present invention. One of the advantages of integrating the system into a chair is that it is a relaxed position for the user, which improves the effects. A further aspect of the invention relates to the chair being configured to reduce stress on the spine of the user. A design that is useful both in terms of relaxing the body of the user generally and for relaxing the part of the back adjacent to the mesenterial and internal organs' Pacinian corpuscle dense regions located in the abdominal cavity of the user is the zero gravity chair.

Figure 13:
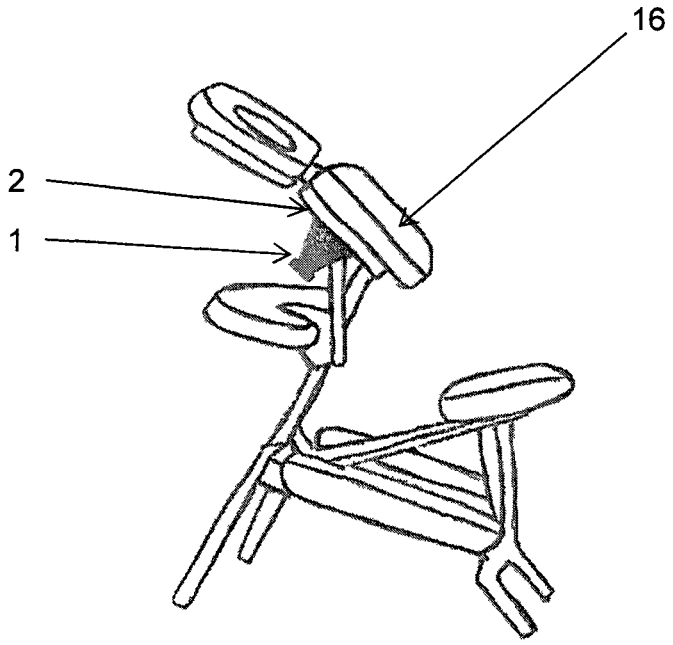
FIG. 13 shows an embodiment of a traditional massage chair incorporating the system for relieving pain according to an embodiment of the present invention.

A further aspect of the presently disclosed invention relates to a chair comprising and/or incorporating the system for relieving pain according to the present invention, wherein the chair is ergonomically designed to support the full body in a seated position. This can be broadly interpreted to include a traditional massage chair for seated massage. One example can be seen in FIG. 13. In this embodiment part of the weight of the user is on the chest support 16, and the transducer 1 and plate 2 may for example be built into or placed behind the lower part of the chest support, adjacent to the mesenterial and internal organs' Pacinian corpuscle dense regions located in the abdominal cavity of the user. These chairs are often foldable and often used in offices, conferences or events for on-site massage.

The invention also relates to a bed comprising and/or incorporating the system for relieving pain. Using a bed can be seen as an even more relaxing position, and in some cases it is also so the user is incapable of moving from the bed. Therefore, in one embodiment the system is built into a bed. The bed may be a zero gravity bed to further reduce the stress on the spine and, generally, stress on the back of the user. This may also improve the propagation of vibrations from the transducer to the user.

EXAMPLES

FIG. 1 shows an embodiment of the presently disclosed system for relieving pain. A powerful electromechanical transducer 1 is placed adjacent to the abdominal cavity 3, on the front side of the body of the user. The transducer is placed in a position that maximizes the effects of the tactile sound waves that are generated to stimulate the Pacinian corpuscles in the mesenterium and the organs of the abdominal cavity. A plate 2, made of a material suitable for propagating the tactile sound waves, is attached to the transducer and in direct contact with the body. The plate is thereby capable of propagating the tactile sound waves to a larger area than the transducer alone.

Figure 2:
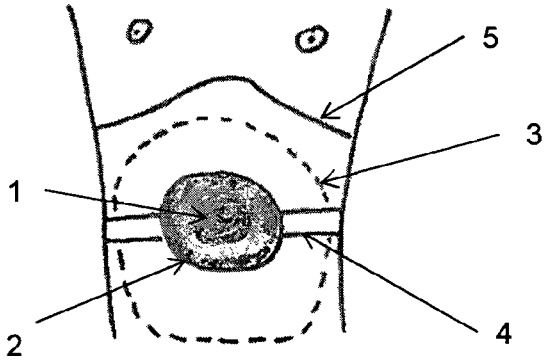
FIG. 2 shows an electromechanical/electroacoustic transducer attached to a plate fixed to the front side of the body of a user by means of a belt.

FIG. 2 shows another embodiment of a pain relieving system according to the present invention. The figure shows the front side of a human body. An electromechanical transducer 1 is attached to a plate 2, made of a material suitable for propagating the tactile sound waves. A belt 4, tightened around the user, holds the transducer 1 and plate 2 in contact with the body during an examination and/or treatment session. As explained in the details section, the target for the tactile sound waves is the Pacinian corpuscle dense regions in the abdominal cavity 3 of the user. It is recommended that the plate is placed so that it only is in contact with soft tissue since the propagation of strong vibrations in the skeleton can be unpleasant for the user and perturb the state of relaxation. In this regard the lowest rib 5 constitutes an upper limit to where the plate can be placed.

Figure 3:
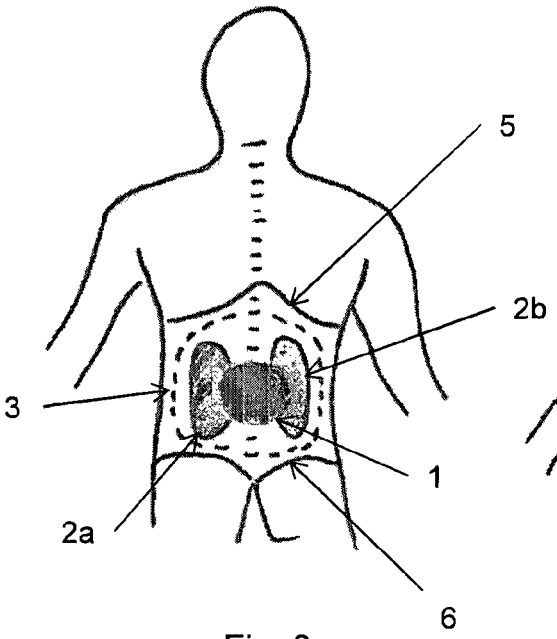
FIG. 3 shows a plate shaped to connect only to soft tissue on the back side of the body of a user.

In FIG. 3 the pain relieving system is placed on the back side of the body. Two plates 2*a* and 2*b* are in contact with the soft tissue adjacent to the abdominal cavity 3 of the user. The transducer 1 is attached so that the tactile sound waves are propagated to both plates 2*a* and 2*b*. The plates are only in contact with the soft tissue and not with any bones. In this regard the lowest rib 5 constitutes an upper limit to where the plates can be placed. Similarly the hip bone 6 constitutes a lower limit for the placement of the plates.

Figure 4:
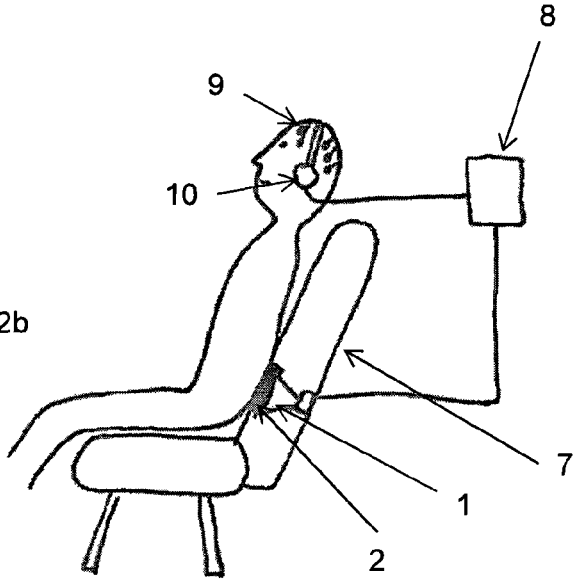
FIG. 4 shows an embodiment of the presently enclosed system for relieving pain, wherein the electromechanical transducer (drawn as a loudspeaker symbol) is built-in to the backrest of a chair, further comprising headphones and a controller responsible for playing music and controlling the tactile sound wave parameters of the electromechanical transducer. The controller may also comprise a computer implemented system for determining a set of tactile sound wave parameters based on the collected data of brain responses from the tests in the examination session.

FIG. 4 shows another embodiment of the present invention comprising a chair 7, in which the transducer 1 and its holder and plate 2 are built-in. A controller 8 controls the transducer. For the examination session this means executing the test patterns. In an examination session the controller also collects the measured patient data, which is collected by means of e.g. EEG electrodes (9). In a treatment session the controller is also responsible for playing music to the patient e.g. through headphones (10), and for synchronizing the transducer 1 with tones or channels in the music.

Figure 5:
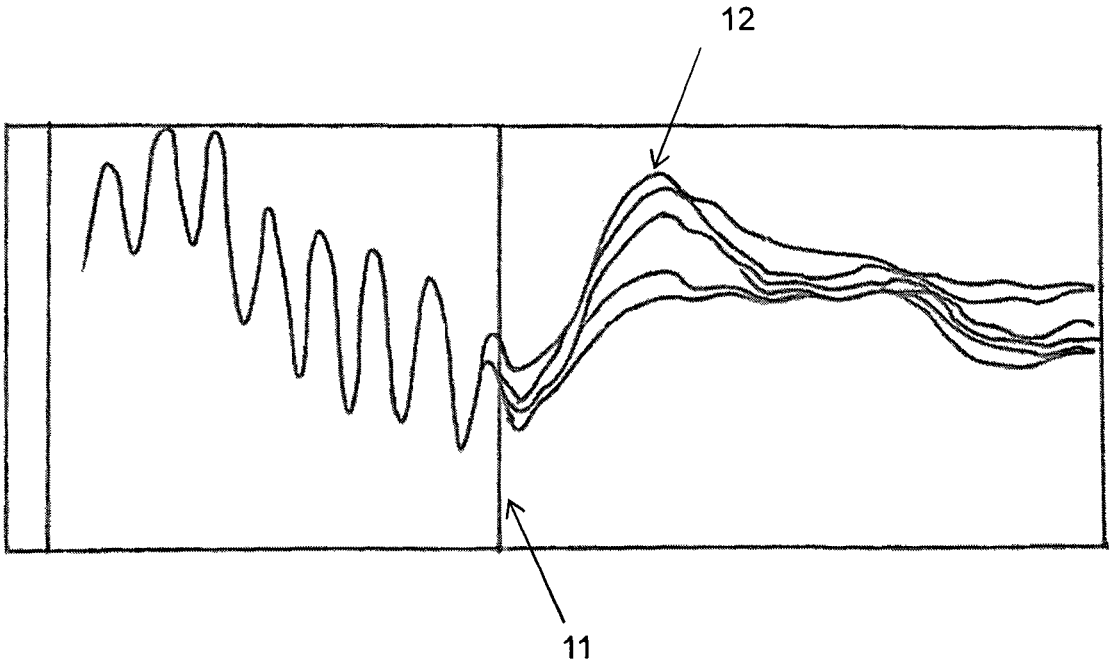
FIG. 5 shows an evoked potential graph for a test of tactile sound wave parameters.

FIG. 5 shows an evoked potential graph for one test (stimulation) in an examination session with the electrical potential on the y axis and time on the x axis. The part to the left of the time indication 11 corresponds to a number of vibrotactile stimulations at a given frequency. At time indication 11 the stimulation stops. The part of the curve to the right of the time indication 11 shows the brain response from the stimulation. The peak response 12 occurs at a time after the stimulation that corresponds to the time it takes for the Pacinian corpuscle to react and send the signal to the brain area where the electrode is located. In the present invention, an examination session repeats the test in FIG. 5 with different stimuli frequencies and amplitudes. Each test generates an evoked potential graph as the one in FIG. 5. The amplitudes of the peak response 12 can then be compared for all the tests, ranked according to peak amplitudes, and the most efficient set of frequency and amplitude parameters for the tactile sound waves can be determined.

Figure 6:
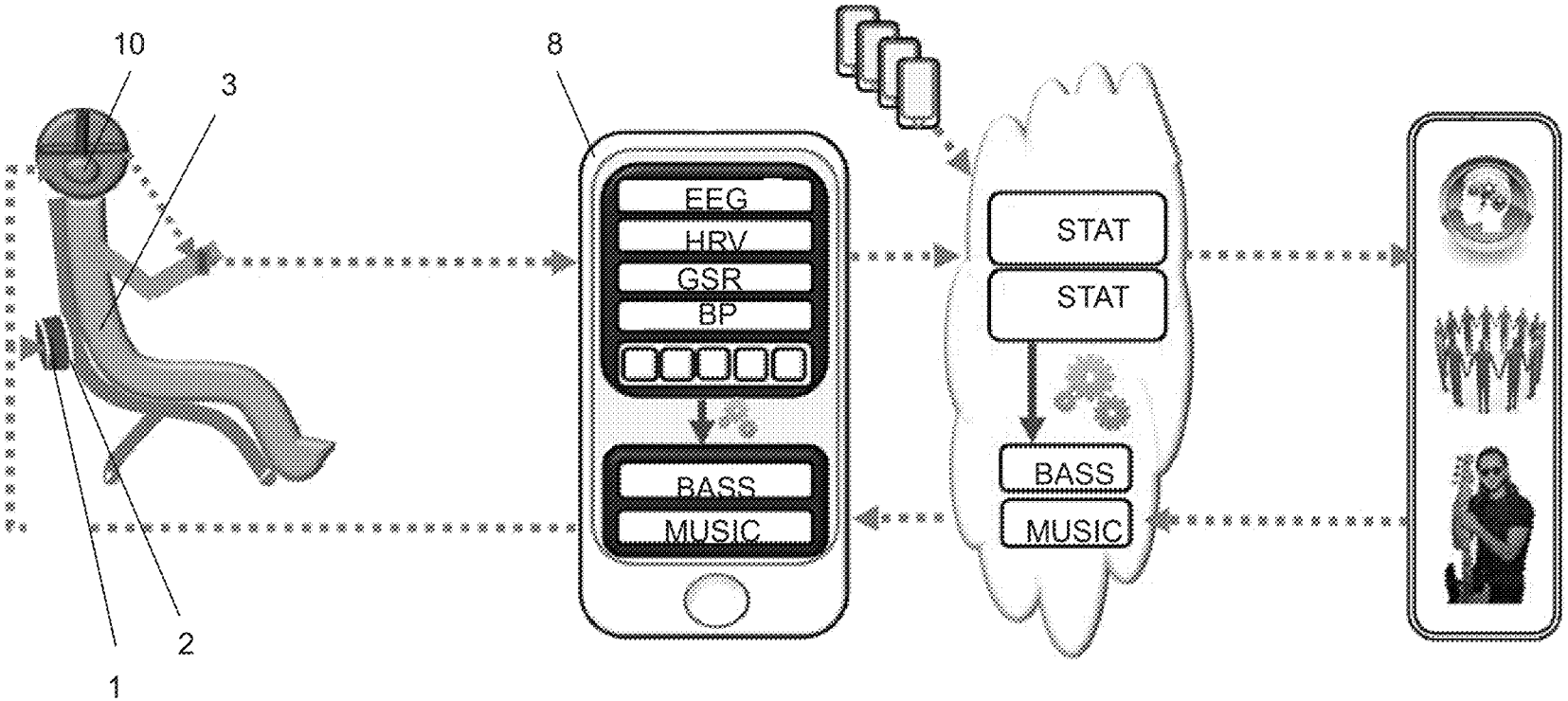
FIG. 6 shows an overview of an embodiment of a system for relieving pain according to the presently disclosed invention, comprising a chair, sensors, a controller configured to control the amplitude and frequency of the transducer and an audio playback unit for playing music to the user.

FIG. 6 shows an overview of an embodiment of a system for relieving pain according to the presently disclosed invention, comprising a chair, sensors, a controller configured to control the amplitude and frequency of the transducer and an audio playback unit for playing music to the user. In this embodiment the transducer is placed on the backside of the backrest of the chair. This example also comprises a combined headset that is able to play music and for performing electroencephalography. The figure also illustrates biosensors. These sensors may also be incorporated in the chair, for example in or on the armrests. This example also shows how a system, comprising other users, a cloud, and a community, may be implemented.

FIG. 7 shows an embodiment of a chair 7 comprising an embodiment of a system for relieving pain according to the presently disclosed invention. In this example the chair can be adjusted to put the user in a zero gravity position. The chair has a pocket 13 in the backrest, in which the plate and/or at least one gel bag(s) can be placed.

Figure 8:
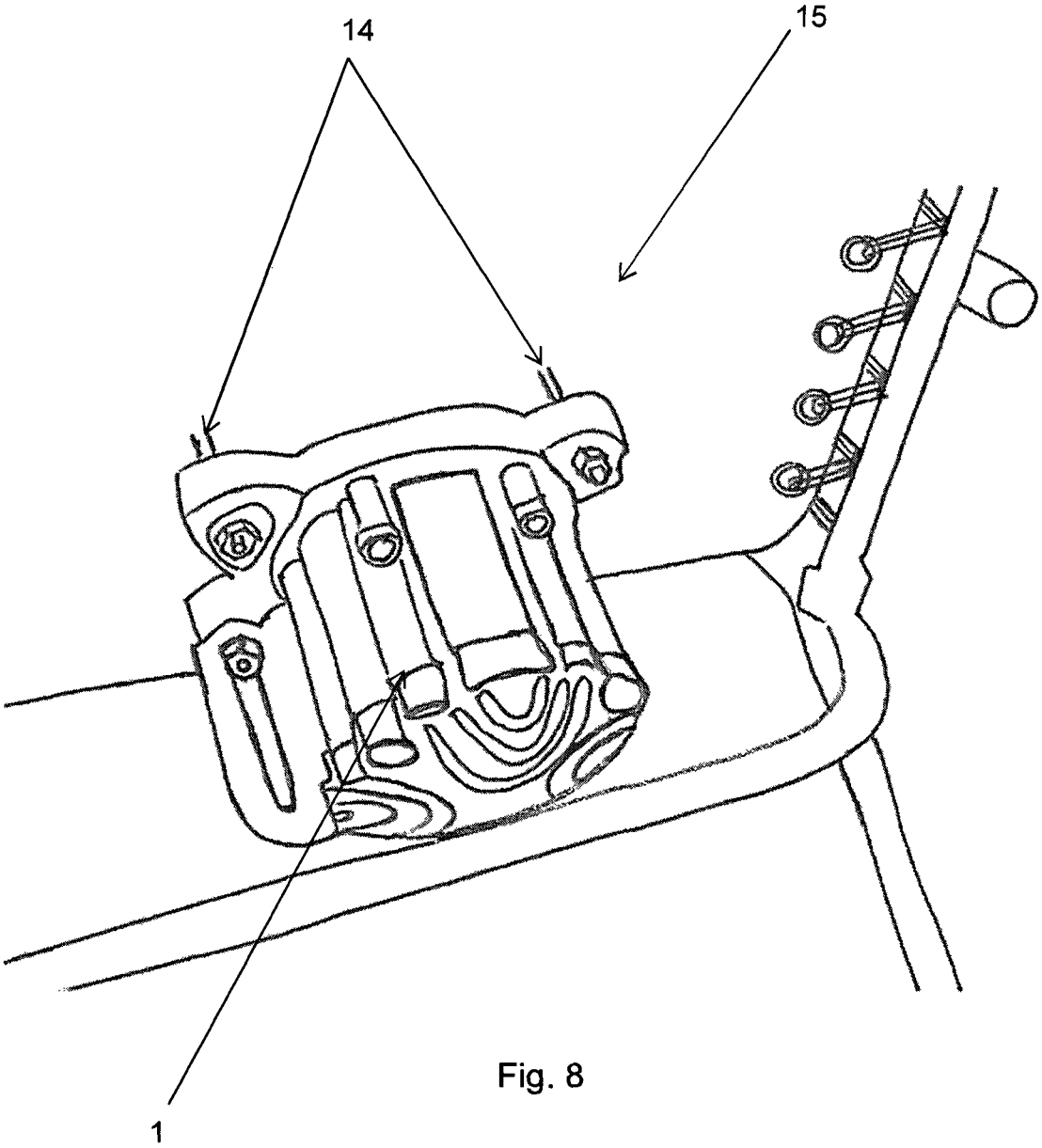
FIG. 8 shows the transducer on the backside of the backrest of the chair in FIG. 7.
Figure 9:
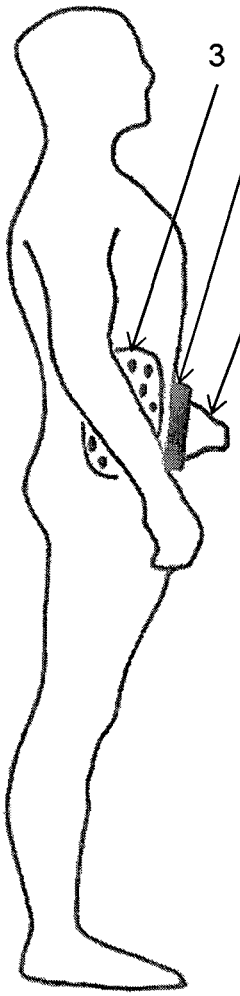
FIG. 9 shows an electromechanical/electroacoustic transducer (drawn as a loudspeaker symbol) attached to a plate made of a material suitable for propagating tactile sound waves (vibrations), fixed to the front side of the body of a user.
Figure 10:
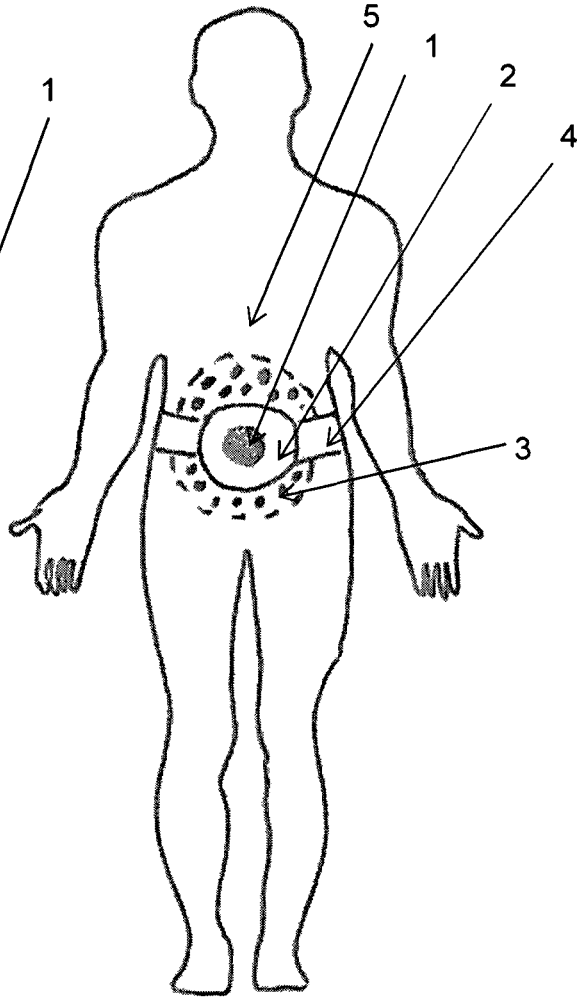
FIG. 10 shows an electromechanical/electroacoustic transducer attached to a plate fixed to the front side of the body of a user by means of a belt.
Figure 11:
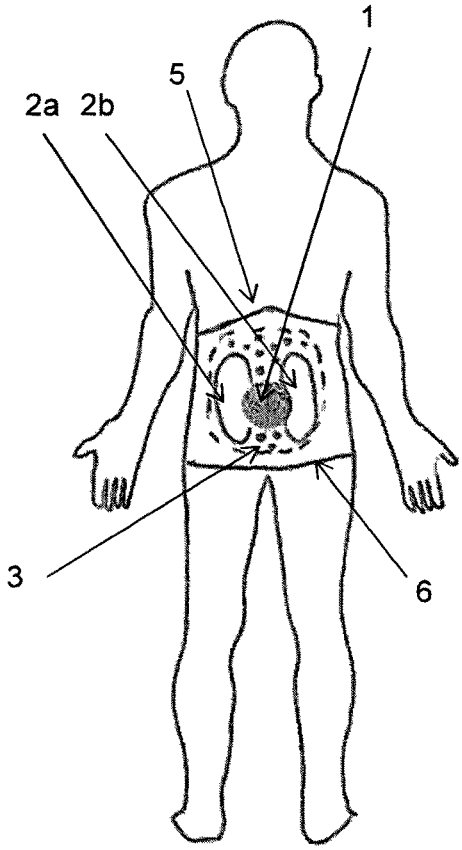
FIG. 11 shows a plate shaped to connect only to soft tissue on the back side of the body of a user.
Figure 12:
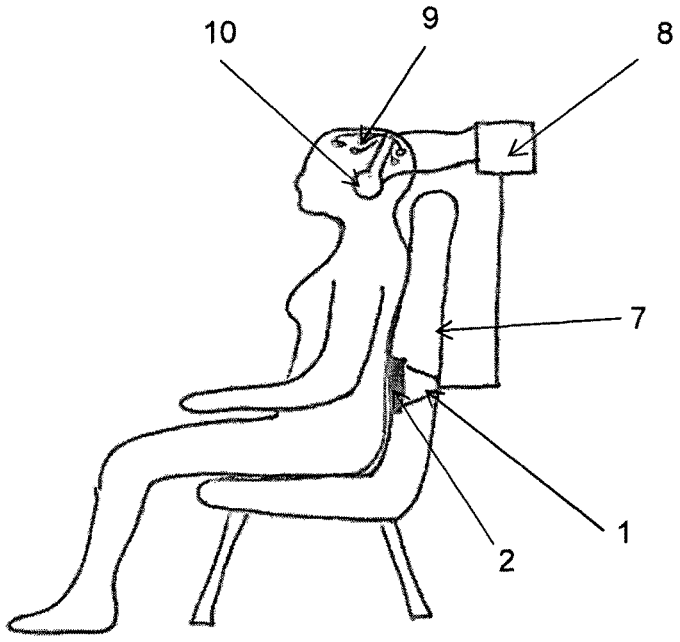
FIG. 12 shows an embodiment of the presently enclosed system for relieving pain, wherein the electromechanical transducer (drawn as a loudspeaker symbol) is built-in to the backrest of a chair, further comprising headphones and a controller responsible for playing music and controlling the tactile sound wave parameters of the electromechanical transducer. The controller may also comprise a computer implemented system for determining a set of tactile sound wave parameters based on the collected data of brain responses from the tests in the examination session.

FIG. 8 shows the transducer 1 according to the present invention mounted on the backside of the backrest 15 of the chair according to the present invention. In this example it can be noted how the transducer 1 is mounted on rods 14 extending through the backrest of the chair.

The invention claimed is:

1. System for relieving pain of a user comprising:

an electromechanical transducer arranged to generate tactile sound waves with a frequency between 5 Hz and 200 Hz;

a holder arranged to keep the transducer in a fixed position adjacent to the mesenterial and internal organs' Pacinian corpuscles located in the abdominal cavity of the user, said transducer arranged to stimulate the Pacinian corpuscles in the mesenterium and the organs of the abdominal cavity;

a computer implemented system for determining a set of tactile sound wave parameters, wherein the computer implemented system is configured to perform the steps of:

executing a predefined sequence of tests of tactile sound waves between 5 Hz and 200 Hz, stimulating the Pacinian corpuscles located in the abdominal cavity of the user, wherein each test corresponds to a set of frequency and amplitude parameters, collecting brain response data from the user for each test, obtaining a collection of data, selecting the most efficient set of tactile sound wave parameters for the user by ranking the collection of data of brain responses for each of the tests; and a controller arranged to control the amplitude and frequency of the transducer according to the selected set of tactile sound parameters.

2. System according to claim 1, wherein the holder is configured such that the electromechanical transducer is placed on the front side of the body adjacent to the abdominal cavity of the user.

3. System according to claim 1, wherein the holder is configured such that the electromechanical transducer is placed on the back side of the body adjacent to the abdominal cavity of the user.

4. System according to claim 1, wherein the holder comprises a belt, band or strap, to which the electromechanical transducer is attached.

5. System according to claim 1, wherein the holder comprises a plate configured to transfer the tactile sound waves from the transducer to the body of the user.

6. System according to claim 5, wherein the plate is shaped to connect only to soft tissue on the body of the user.

7. System according to claim 1, further comprising at least one metal rod, wherein (a) proximal end(s) of the rod(s) is/are attached to the plate, and (a) distal end(s) is/are attached to the transducer.

8. System according to claim 7, wherein the rod(s) is/are mounted substantially perpendicular to the plate.

9. System according to claim 7, wherein the transducer is detachable from the rod(s).

10. System according to claim 1, wherein the holder of the electromechanical transducer is built-in to or on to a backrest of a chair.

11. System according to claim 10, said rod(s) extending through the backrest of the chair, wherein the transducer is mounted on the rod(s) on the backside of the backrest of the chair.

12. System according to claim 1, further comprising at least one bag of gel placed between the user and the transducer, wherein the at least one bag of gel is configured to transfer the tactile sound waves from the transducer to the user.

13. System according to claim 12, wherein the at least one bag of gel is built-in to the backrest of the chair.

14. System according to claim 1, further comprising an accelerometer configured to measure a vibration impact on the patient from the transducer.

15. System according to claim 14, the accelerometer further comprising an alarm element configured to generate an alert if the measured vibration exceeds a predefined limit.

16. System according to claim 15, wherein the predefined limit is in the range of 0.1-1.0 $m/s^2$.

17. System according to claim 1, further comprising an audio playback unit for playing music to the user.

18. System according to claim 17, wherein the controller is configured such that the generated tactile sound waves are synchronised with at least a part of tones in a predefined frequency range, in the music played to the user.

19. System according to claim 17, wherein the controller is configured such that the generated tactile sound waves are synchronised with the beat of the music played to the user.

20. System according to claim 17, wherein the controller is configured such that the generated tactile sound waves are synchronised with the tones in a selected channel of the music played to the user.

21. System according to claim 17, wherein the controller is configured such that the tactile sound waves are characterized by the audio waves in the music within the frequency range supported by the electromechanical transducer.

22. System according to claim 1, further comprising a device configured to manually register levels of mood and pain of the user.

23. System according to claim 1, further comprising sensors configured to measure electrocardiography, and/or hear rate variability, and/or electromyography, and/or galvanic skin response.

24. System according to claim 23, wherein the amplitude and/or frequency of the transducer and/or the music played to the user is based on the electrocardiography, and/or heart rate variability, and/or electromyography, and/or galvanic skin response.

25. System according to claim 1, further comprising a camera configured to measure a diameter of a pupil of the user.

26. System according to claim 1, wherein the generated tactile sound waves are sensed through the body.

27. System according to claim 1, wherein the frequency and amplitude of the tactile sound waves are combined such that the Pacinian corpuscles in the mesenterium and the organs of the abdominal cavity are stimulated by the generated tactile sound waves.

28. Method for determining a set of tactile sound wave parameters, comprising the steps of:

providing a collection of brain response data from a user, wherein said brain response data was collected while the Pacinian corpuscles located in the abdominal cavity of the user were stimulated by executing a predefined sequence of tests of tactile sound waves between 5 Hz and 200 Hz, wherein each test corresponds to a set of frequency and amplitude parameters;

selecting the most efficient set of tactile sound wave parameters for the user by ranking the collection of data of brain responses for each of the tests.

29. Method according to claim 28, wherein the brain response data comprises subjective data provided manually by the user.

30. Method according to claim 28, wherein data pairs for a number of single stimulations are collected and averaged, each data pair comprising a stimulation and a brain response.

31. Method according to claim 28, wherein the collection of data is an evoked potential.

32. Method according to claim 28, wherein the collection of data is the spontaneous electrical activity of an electroencephalography (EEG).

33. Method according to claim 28, wherein the collection of data is the spontaneous electrical activity of an electromyography (EMG).

34. Method according to claim 28, wherein the tactile sound wave is a sinusoidal wave.

* * * * *